US005320001A

United States Patent [19]

Floyd

[11] Patent Number: 5,320,001

[45] Date of Patent: Jun. 14, 1994

[54] METHOD OF ASSEMBLYING HAMMER

[76] Inventor: Ted Floyd, 453 Grand Ave., Spring Valley, Calif. 91977

[21] Appl. No.: 61,042

[22] Filed: May 14, 1993

[51] Int. Cl.[5] ..... B21K 5/14; B21K 11/10

[52] U.S. Cl. ..... 76/103; 403/251; 81/20; 81/23

[58] Field of Search ..... 76/103, 101.1; 403/247, 403/250, 251, 277; 81/20, 23, 24

[56] References Cited

U.S. PATENT DOCUMENTS

| | | | |
|---|---|---|---|
| 964,976 | 7/1910 | Kukuruda | 403/250 |
| 1,199,117 | 9/1916 | Shapleigh | 403/250 |
| 1,203,025 | 10/1916 | McClain | 403/250 |
| 1,318,281 | 10/1919 | Johns | 403/250 |
| 1,445,470 | 2/1923 | Bale | 403/250 |
| 1,518,259 | 12/1924 | Filiatreault | 81/20 |
| 2,437,426 | 3/1948 | Hess | 403/251 |
| 3,128,131 | 4/1964 | Bianchini | 81/20 |
| 3,175,232 | 3/1965 | Stowell | 81/20 |
| 3,888,721 | 6/1975 | Carmien et al. | 76/103 |
| 5,213,023 | 5/1993 | Floyd | 81/20 |

*Primary Examiner*—Roscoe V. Parker
*Attorney, Agent, or Firm*—Charles C. Logan, II

[57] ABSTRACT

A method of assemblying a hammer from a handle, a wedge unit and a hammer head unit. The handle has a top end having a neck portion that has a pair of vertical slots that intersect each other at substantially 90 degrees to each other. The wedge unit is formed from an x-axis wedge and a z-axis wedge section that are oriented to each other at substantially 90 degrees. The hammer head unit has a hammer portion a central portion and a claw portion. The central portion has a bore hole that extends from its top surface to its bottom surface. An arbor press is used to press the wedge section into the grooves on the top end of the handle.

6 Claims, 1 Drawing Sheet

METHOD OF ASSEMBLYING HAMMER

BACKGROUND OF THE INVENTION

The invention relates to a method of assemblying a hammer and more specifically to one having novel structure for the top end of its handle, for its hammer head unit, and the wedge unit that is driven into the top end of the handle.

Prior art hammers generally have a hammer head unit having a handle receiving central portion that only tapers along two of the inside walls of the opening that receives the top end of the handle. The opening at its bottom end is smaller than at its top end. In order to secure the top end of the handle to the hammer head unit, a linear extending wedge is driven down into the top of the handle spreading it in two directions against the two tapered inside wall surfaces of the opening. Sometimes the linear extending wedge does not hold the top of the handle firmly enough in the hammer head unit and it works loose which is annoying and dangerous during use. Existing handles for hammers only have a single vertical slot extending downwardly from their top end for receiving a linear extending wedge.

It is an object of the invention to provide a novel method for assembling a hammer from a handle, a wedge unit and a hammer head unit.

It is also an object of the invention to provide a novel method of assemblying a hammer that provides a more positive structure for securing the top end of the handle to the hammer head unit.

SUMMARY OF THE INVENTION

The novel hammer has a hammer head unit having a handle receiving portion. A four-sided bore hole extends from the top edge of the handle receiving central portion to its bottom edge. The four-sided bore hole is in alignment with the vertical axis of the handle receiving central portion. The four-sided bore hole is formed by a front inside wall, a rear inside wall, and left and right inside walls. All four of these inside walls taper outwardly at a predetermined angle from their bottom edges to their top edges. The structure of the hammer head unit is best illustrated in U.S. Pat. No. 5,213,023 and its specification is incorporated herein by reference to this patent.

The wedge unit has been designed to interrelate with the four-sided bore of the handle receiving central portion of the hammer head unit. The wedge unit is formed from an x-axis wedge section that intersects the z-wedge section at 90 degrees. The length of these two wedge sections is less than the dimensions of the length and width of the four-sided bore hole.

The handle has a top end having a neck portion that has a pair of vertical slots that intersect each other at substantially 90 degrees to each other. An outwardly extending shoulder is formed adjacent the bottom end of the neck portion.

The first step in assemblying the hammer is to insert the neck portion of the handle upwardly through the four-sided bore hole of the hammer head unit. The hammer head unit is then seated on the shoulders of the handle located at the bottom end of the neck portion. Next epoxy glue is poured into the vertical slots of the neck portion and the wedge unit has the bottom of its wedge sections aligned with the vertical slots in the top end of the handle. Following this, the bottom end of the handle is positioned on the top planar surface of an arbor press and the bottom of its rack gear is aligned with the top of the wedge unit. The handle of the arbor press is pulled downwardly causing the rack gear to press the wedge unit into the grooves on the top end of the handle. A conventional state of the art 3 or 5 ton arbor press would preferably be used.

Due to the wedge unit having four fingers that are perpendicular to each other, when it is driven into the top end of the handle it spreads the wood in four directions at 90 degree angles to each. This wedges the top end of the handle tightly within the interior of the four-sided bore hole and grips it in place. There are a plurality of horizontal barbs on each of the wedge sections that increase the gripping power of the wedge unit into the wood of the handle. Additionally the epoxy glue provides additional gripping power that prevents the hammer head unit from flying off the top end of the handle. Since the top surface of the wedge unit is spaced downwardly from the top edge of the bore hole, additional epoxy glue may be poured in this area to fill this cavity.

DESCRIPTION OF THE PREFERRED EMBODIMENT

Figure 1:
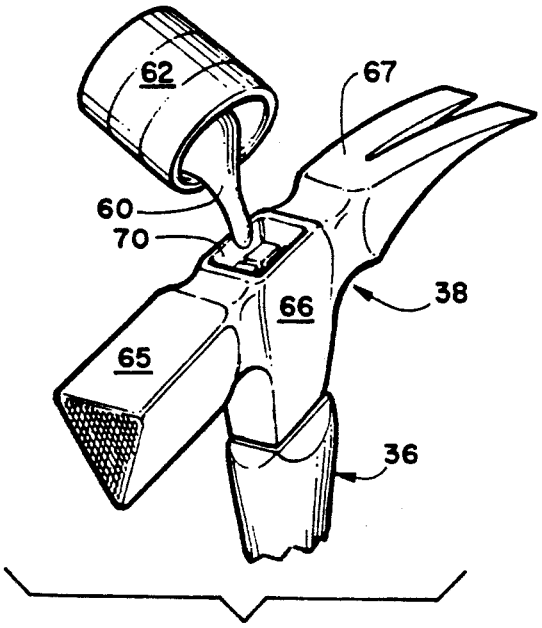
FIG. 1 is an exploded perspective view of the different components of the hammer and showing how it is assembled together with an arbor press.

The novel hammer and the manner in which it is assembled will now be described by referring to FIGS. 1–4 of the drawing. The hammer is generally designated numeral 10.

The arbor press 12 has a base 14 having a top planar surface 16. A post portion 18 extends upwardly from base 14 and it has a head portion 20 that extends transversely to the post portion. A rack gear 22 is mounted in a slot 24 and its movement is actuated by a handle 26 mounted on shaft 28 that has a pinon gear (not shown) that engages the teeth of rack gear 22. The bottom end of rack gear 22 has a protrusion 30 that mates with the top surface of wedge unit 34. Hammer 10 has a handle 36 and a hammer head unit 38.

Figure 2:
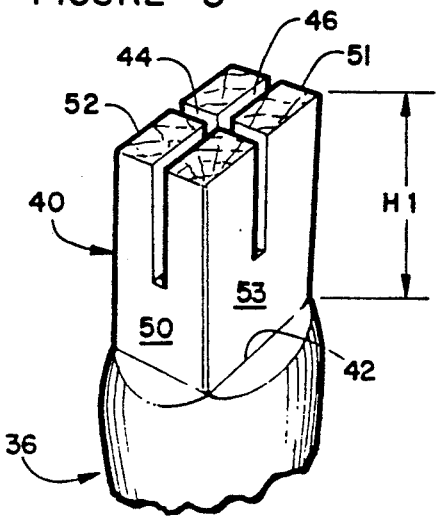
FIG. 2 is a partial perspective view of the top end of the hammer handle.

The top end of handle 36 is best illustrated in FIG. 2. Neck portion 40 has a shoulder 42 formed adjacent its bottom end. Vertical slots 44 and 46 intersect each other at substantially a 90 degree angle. Neck portion 40 has a height H1. It has a planar front wall 50, a planar rear wall 51, a planar left side wall 52 and a planar right side wall 53.

Figure 3:
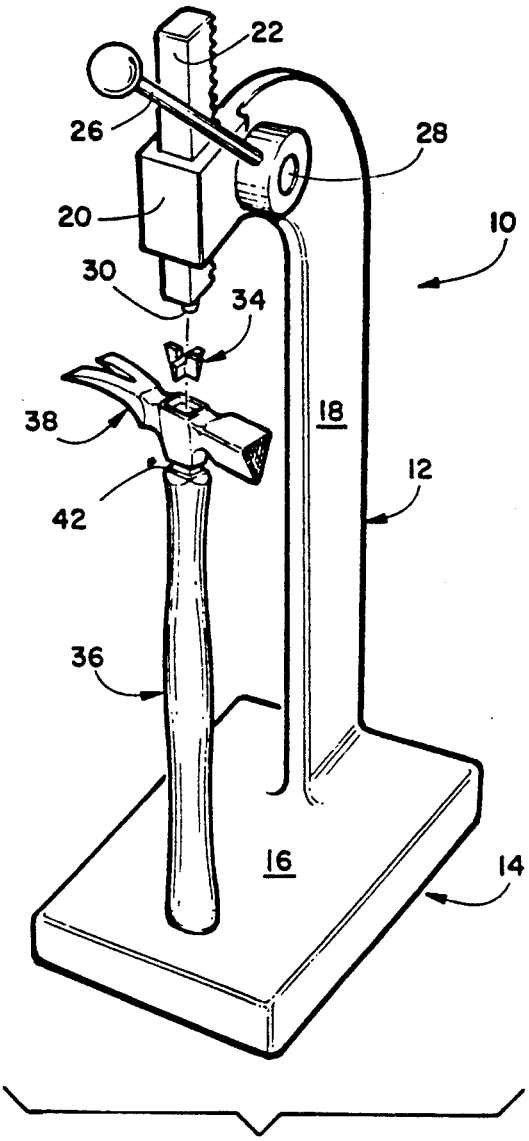
FIG. 3 is a partial exploded perspective view of the wedge unit and hammer head unit.

In FIG. 3, epoxy glue 60 is being poured from a container 62 into the grooves 44 and 46 of handle 36. Hammer head unit 64 has a hammer portion 65, a central portion 66 and a claw portion 67. Central portion 66 bars rectangular bore 70.

Figure 4:
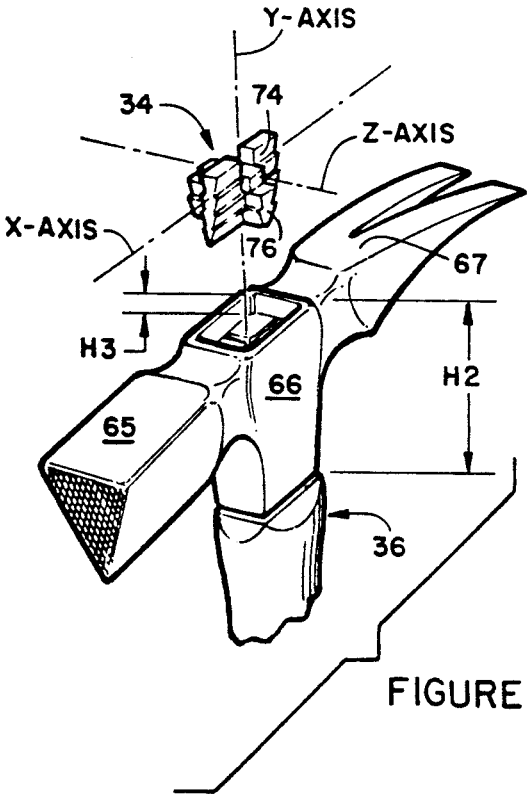
FIG. 4 is a partial perspective view showing epoxy glue being poured into the vertical slots at the top end of the hammer handle.

Wedge unit 34 is best illustrated in FIG. 4. Wedge 34 has a wedge section 74 that extends along the x-axis and a wedge section 76 that extends along the z-axis. Rectangular bore 70 has a height H2 that is grater than the height Hi of neck portion 40. A cavity having a height H3 is formed between the top of the neck portion 40 and the top edge of rectangular bore 70.

What is claimed is:

1. A method of assemblying a hammer from a handle, a wedge unit and a hammer head unit wherein the handle has a top end having a neck portion that has a pair of vertical slots that intersect each other at substantially 90 degrees to each other and wherein the wedge unit is formed from an x-axis wedge section and a z-axis wedge section that are oriented to each other at substantially 90 degrees and wherein said hammer head unit has a hammer portion, a central portion and a claw portion, said central portion having top surface, a bottom surface and a bore hole that extends from its top surface to its bottom surface and wherein the method of assembly comprises the following steps:

(a) inserting the neck portion of said handle into the bottom end of the bore hole of said hammer head unit;

(b) aligning the bottom of the wedge sections of said wedge unit with the vertical slots in the top end of said handle;

(c) positioning said handle vertically with its bottom end supported on the top surface of the base of an arbor press, said arbor press having an upright oriented post portion having a transversely extending head portion at its top end, said head portion having a vertically oriented four-sided bore hole that receives a reciprocally mounted rack gear having a bottom end, the bottom end of said rack gear being aligned with the top surface of said wedge unit, and actuating the handle of said arbor press to cause the bottom end of said rack gear to press said wedge unit into the grooves on the top end of said handle and lock said wedge unit in the interior of the bore hole of said hammer head unit.

2. A method of assemblying a hammer as recited in claim 1 wherein said handle has a shoulder formed at the bottom of its neck portion and the central portion of said hammer head unit seats against said shoulder.

3. A method of assemblying a hammer as recited in claim 1 wherein the bore hole of the central portion of said hammer head unit has a rectangular four-sided shape.

4. A method of assemblying a hammer as recited in claim 1 further comprising the step of applying epoxy glue to the top end of said handle prior to pressing said wedge unit into the vertical slots at the top end of said handle.

5. A method of assemblying a hammer as recited in claim 1 wherein the bore hole of the central portion of said hammer head unit has a height H2 and the neck portion of said handle has a height H1 and H2 is greater than H1 by a predetermined amount H3.

6. A method of assemblying a hammer as recited in claim 5 wherein epoxy glue is applied to the top end of the bore hole of said hammer unit after assembly step (c) to fill in the space H3.

* * * * *